US005502852A

United States Patent [19]

Fredman et al.

[11] Patent Number: 5,502,852

[45] Date of Patent: Apr. 2, 1996

[54] EXTENSIBLE FOLDING LEG FOR BED CROSS BAR

[75] Inventors: Irving Fredman; Carmi Fredman, both of St. Louis, Mo.

[73] Assignee: Fredman Brothers, St. Louis, Mo.

[21] Appl. No.: 242,123

[22] Filed: May 13, 1994

[51] Int. Cl.[6] ..... A47C 19/02; A47C 19/04

[52] U.S. Cl. ..... 5/203; 5/312; 248/188.4

[58] Field of Search ..... 5/203, 310, 312, 5/201, 202, 200.1, 181, 184, 185, 285, 286, 282.1; 248/188.4

[56] References Cited

U.S. PATENT DOCUMENTS

| | | | |
|---|---|---|---|
| Re. 27,182 | 9/1971 | Fredman . | |
| 3,031,689 | 5/1962 | Sark | 5/310 |
| 3,848,280 | 11/1974 | Allen et al. | 5/312 |
| 4,038,710 | 8/1977 | Tambascio | 5/310 |
| 4,078,271 | 3/1978 | Tambascio | 5/310 |
| 4,080,674 | 3/1978 | Fredman et al. | 5/310 |
| 4,103,374 | 8/1978 | Knoke | 5/310 |
| 4,354,287 | 10/1982 | Fredman | 5/202 |
| 5,203,039 | 4/1993 | Fredman | 5/203 |
| 5,231,713 | 8/1993 | McDonnell | 5/310 |

*Primary Examiner*—Alexander Grosz
*Attorney, Agent, or Firm*—Polster, Lieder, Woodruff & Lucchesi

[57] ABSTRACT

A leg for a cross bar for king and queen size beds which leg is nested in the cross bar for shipping and movable to an erect position to support the cross bar above the floor. The leg has an integral bracket on its free end which is formed from the leg and defines a substantially square opening which retains a plastic bushing and a threaded foot which can be adjusted toward and away from the leg bracket to raise or lower the cross bar.

10 Claims, 2 Drawing Sheets

EXTENSIBLE FOLDING LEG FOR BED CROSS BAR

BACKGROUND OF THE INVENTION

1. Field of the Invention

This invention relates to beds and wooden bed rails which have metal cross bars and foldable extensible legs on the cross bars. This invention is particularly applicable to queen and king size beds which require legs on the cross bars to support the extra width and weight of such beds and bedding.

This invention also relates to a universal bed rail support system which is usable with the higher off the floor style beds currently in fashion. These beds require legs of heights from eight inches to eighteen inches which is the distance from the lip of the bed rail to the floor. These beds conventionally have wood side rails and it is to this field that this invention is specifically directed.

2. Description Of the Prior Art

In prior U.S. Pat. No. 5,203,039 of Irving Fredman, a co-inventor hereof, there is described a laterally adjustable cross bar and a cross bar adjustable in height. This invention is a specific improvement on the structure shown in U.S. Pat. No. 5,203,039 which is easier to fabricate and is less expensive to make. It does not use any welds, has only a single rivet connection to the cross bar, and is formed from a single length of metal angle.

Thus, it is a primary object of this invention to provide an extensible and foldable leg for a bed frame cross bar which is simple and inexpensive to fabricate and which is usable for frames for queen and king size beds. The leg of the invention is adjustable in height and foldable into the cross bar for shipping and is pivoted to the cross bar for easy erection by the user. These and other objects and advantages will become apparent hereinafter.

SUMMARY OF THE INVENTION

This invention comprises a leg for a cross bar used with a queen or king size bed and which is extensible and foldable into the cross bar and is easy and inexpensive to fabricate from a single length of angle.

DESCRIPTION OF THE DRAWINGS

In the accompanying drawings which form part of the specification and wherein like numerals and letters refer to like parts wherever they occur.

DETAILED DESCRIPTION

This invention is an improvement on the folding leg structure 30–65 defined in U.S. Pat. No. 5,203,039 and is adapted to be pivotally connected to the cross bar structure defined by the numbers 10–27. The structure of U.S. Pat. No. 5,203,039 is hereby incorporated by reference to the extent necessary to define a background for a completion of the present disclosure.

Figure 1:
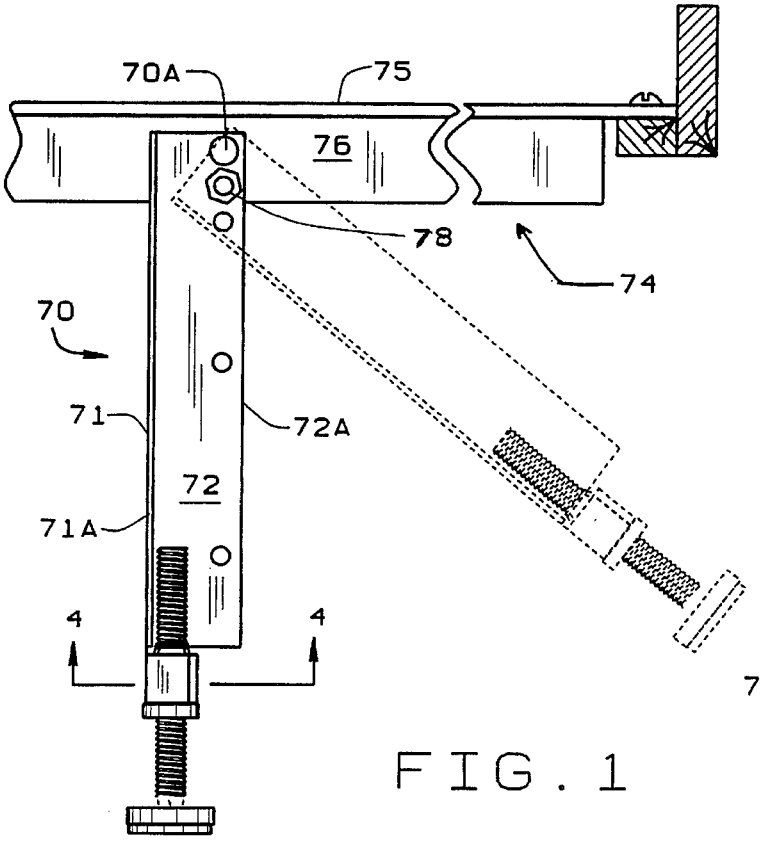
FIG. 1 is a fragmentary side elevational view of the leg attached to a bed cross bar showing in solid line in erected position and showing in broken lines movement of the leg toward nested shipping configuration.
Figure 5:
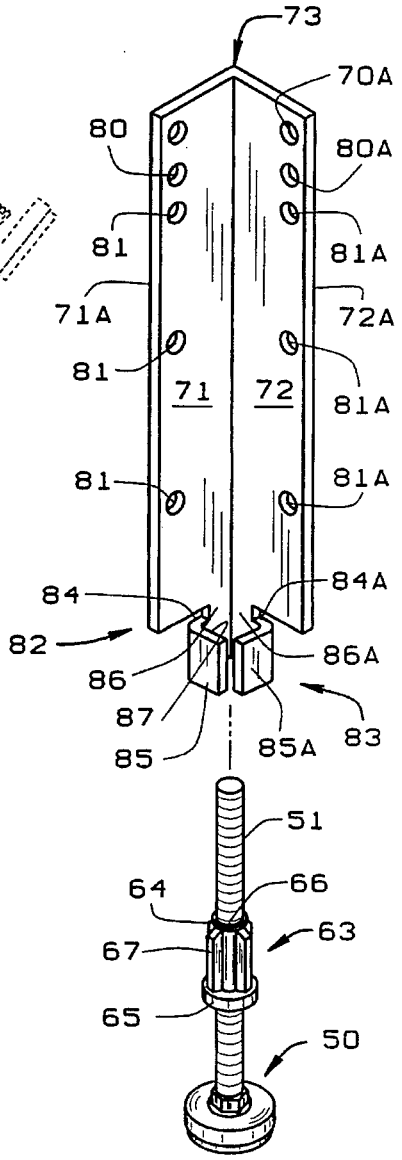
FIG. 5 is an exploded perspective view of the leg and extensible foot.
Figure 3:
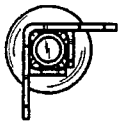
FIG. 3 is a top plan view of the leg.
Figure 4:
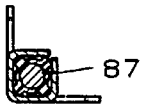
FIG. 4 is a sectional view taken along line 4—4 of FIG. 1.
Figure 2:
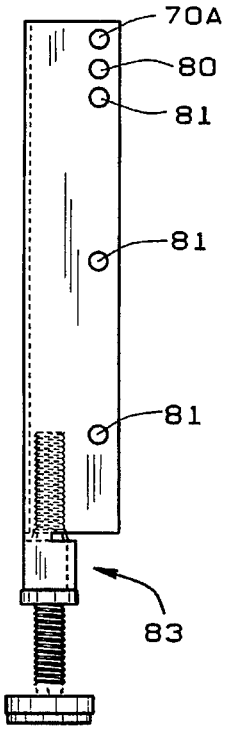
FIG. 2 is a side elevational view of the leg.

The improvement in the present invention comprises the pivoted leg 70 which is an "L" shaped angle having flanges 71 and 72 which have free edges 71*a* and 72*a* and are connected at 73 to define a right angle. The leg 70 is shown in FIG. 1 as pivotally connected at 70A to a cross bar 74. The pivotal connection 70A may be a rivet or may be a nut and bolt connection. The cross bar 74 is an "L" angle and includes a horizontal flange 75 and a right angular vertical flange 76. The leg 70 has opposed openings 80, 80*a* (FIG. 5) in the flanges 71 and 72, respectively, adjacent to the pivot 70A. A bolt and locknut fastening assembly 78 fastens the leg 70 to the cross bar 74 and locks the leg 70 in erected position with respect to the cross bar 74. Thus, when the fastening assembly 78 is removed from the cross bar 74, the leg 70 can be pivoted into the cross bar 74 so it is nested therein in shipping position.

A series of spaced aligned openings 81, 81*a* are placed in each flange 71 and 72 respectively adjacent to the edges 71*a* and 72*a* for connection to an extension member 55 as will be explained hereinafter in the description of FIGS. 6–8.

The free leg end 82, which is remote from the pivotal connection 70A where the leg 70 is attached to the cross bar 74, is provided with a substantially square bracket 83. The bracket 83 is formed by making opposed cuts or slots 84, 84*a* in the flanges 71, 72 from the edges 71*a*, 72*a* toward the juncture 73 of the flanges 71, 72. The segments 85, 85*a* formed by the cuts 84, 84*a* are bent toward each other at substantially right angles to form a substantially square opening 87 inside of the bracket 83. The slots 84, 84*a* extend slightly more than one half the distance from the edges 71*a*, 72*a* to the center edge 73 so that the segments 85, 85*a* can be formed into a right angle, but still leave webs 86, 86*a* adjacent to the edge 73 of sufficient strength to support an extensible foot 50.

An independent plastic insert 63 is designed for positioning in the bracket opening 87. The insert or bushing 63 accommodates a vertically adjustable foot 50 on a threaded stem 51 for adjusting the height of the cross bar 74 above the surface on which the bed is positioned. By the shown structure, the leg 70 with its integral bracket 83 can be fabricated by a stamping and forming operation and does not require the riveting of U.S. Pat. No. 5,203,039 or spot welding or other labor intensive operation. Less material is used in the present structure also.

The insert 63 and foot 50 are identical to those shown in U.S. Pat. No. 5,203,039. The insert 63 comprises a body member 64 which is designed to fit inside the bracket opening 87. The body member 64 has a flange 65 on one end thereof which is larger than the bracket opening 87 and a threaded throughbore 66 extends through the flange 65 and the body member 64. External ribs 67 are positioned around the outer periphery of the body member 64 and are adapted to engage and be compressed within the bracket opening 87 to thereby retain the insert 63 in said opening 87.

The foot 50 has a threaded stem 51 extending therefrom, is engaged in the threaded throughbore 66 and provides an adjustable leg in which the distance from the foot 50 to the cross bar 74 can be finely adjusted by threading the stem 51 through the threaded throughbore.

Figure 6:
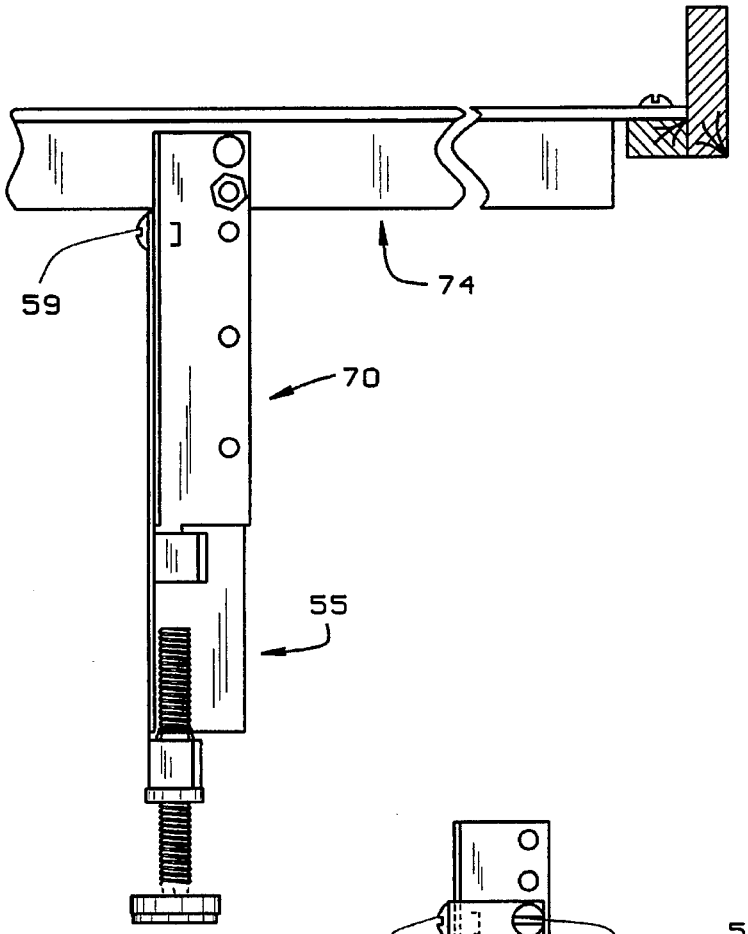
FIG. 6 is a fragmentary side elevational view similar to FIG. 1 showing a modification of the invention.
Figure 7:
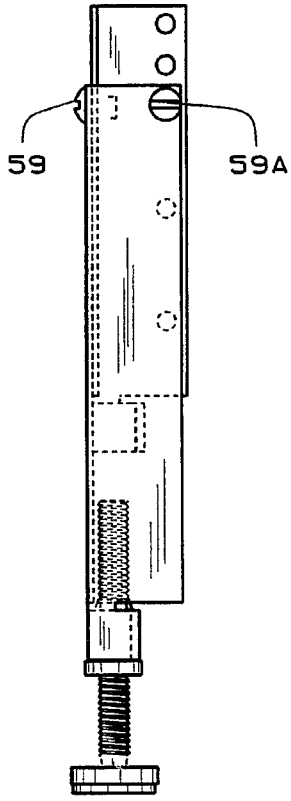
FIG. 7 is a side elevational view of the device of FIG. 6.
Figure 8:
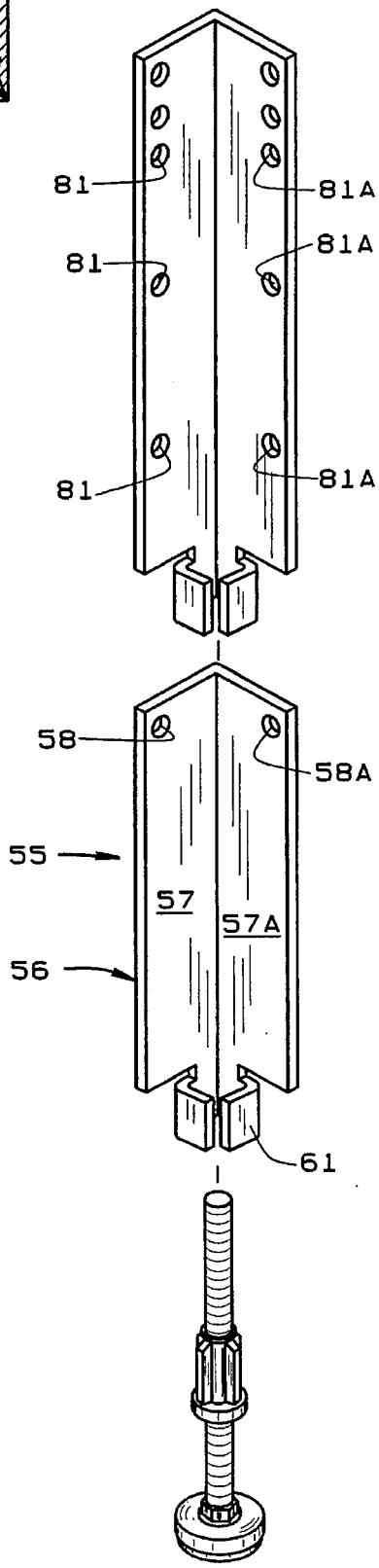
FIG. 8 is an exploded perspective view of the modification of FIG. 6.

FIGS. 6, 7 and 8 show an extension member 55 which is adapted to be attached to a leg 70 to extend the distance from the cross bar 74 to the surface on which the bed is placed. The extension member 55 allows the cross bar 74 to be used on beds which have heights of about eight to about eighteen inches from the floor which beds are currently used with wooden side rails. The extension member 55 is very similar to the leg 70 in construction and has an "L" angle body 56 which is defined by two right angular side flanges 57, 57*a*. The flanges 57, 57*a* have opposed aligned openings 58, 58*a* adjacent to the top ends for attachment to corresponding openings 81, 81a in the main legs 70.

This extension leg 55 fits over and embraces the leg 70 so that the opening 58 in the extension leg 55 is aligned with one of the openings 81 in the leg 70. At the same time, the opposed opening 58*a* in the extension leg 55 is aligned with the opposed opening 81*a* in the leg 70.

Suitable fastening means 59, 59*a* are positioned through the openings 58 and 81 and 58*a* and 81*a* respectively to securely engage the extension member 55 to the leg 70 (FIGS. 6 and 7.

The extension member 55 has a substantially square bracket 61 positioned at the free end thereof to accommodate a plastic insert 63. The bracket 61 is formed as hereinbefore described for the bracket 83, and it retains an insert 63 which holds the extensible foot 50.

The free end of the stem 51 on the foot 50 is designed to pass into the opening 87 defined by the bracket 83 in the main leg 70. Thus, by using the extension 55, the cross bar 74 can be used with beds that have side rails anywhere from eight to eighteen inches from the floor.

This invention is intended to cover all changes and modifications of the example of the invention herein chosen for purposes of the disclosure which do not constitute departures from the spirit and scope of the invention.

What is claimed is:

1. In a cross bar adjustable in height for interconnecting the side rails of a bed, the cross bar being an "L" angle section having horizontal and vertical webs, the improvement comprising a) an "L" angle leg having flanges and being pivotally connected to the vertical web of the cross bar intermediate its ends and movable into nested position with the cross bar from an extended operating position perpendicular to the cross bar, b) means for securing the leg in operating position, c) a bracket integrally formed from the end of the leg remote from its pivotal connection to the cross bar, said bracket being defined by cut outs in the leg flanges from the free edges of the flanges toward their intersection and inwardly turned free ends formed by the cut outs defining an opening, d) a plastic insert positionable in the opening defined by the bracket, said insert having 1. a body member adapted to fit in the opening,
2. a flange larger than the opening at one end of the body, and
3. a threaded throughbore through the flange and the body member, and e) a foot having a threaded stem extending therefrom and adapted to engage the threaded throughbore to provide an adjustable leg in which the distance from the foot to the bar can be adjusted by threading the stem through the threaded throughbore.

2. The device of claim 1 wherein the inwardly turned free ends are bent at substantially right angles toward each other to define with the uncut portions a substantially square opening.

3. The cross bar of claim 1 wherein the means for securing the leg in operating position includes aligned openings in the cross bar vertical web and one flange of the leg and means for interconnecting the openings.

4. The cross bar of claim 1 including more than one leg pivotally secured to the cross bar.

5. The cross bar of claim 1 wherein the insert has external ribs on the body member adapted to engage the square opening and hold the insert in the opening.

6. In a universal cross bar adjustable in height for interconnecting the side rails of a bed, the cross bar being an "L" angle section having horizontal and vertical webs, the improvement comprising a) an "L" angle main leg having flanges and being pivotally connected to the vertical web of the cross bar intermediate its ends and movable into nested position with the cross bar from an extended operating position perpendicular to the cross bar, b) means for securing the main leg in operating position, c) the main leg flanges being provided with a series of aligned spaced openings, d) a bracket integrally formed from the end of the main leg remote from its pivotal connection to the cross bar, said bracket defining an opening, e) an extension member adapted to be attached to the main leg to extend the distance from the cross bar to the surface on which the bed is placed to accommodate greater bed heights, said extension member comprising 1. an "L" angle body,
2. opposed openings in the two sides of the "L" angle adjacent to the top end of the body for attachment to corresponding openings in the leg flanges of the main leg, and
3. a bracket integrally formed from the end of the extension member remote from its connection to the main leg, said extension bracket being defined by cut outs in the leg flanges from the free ends of the flanges toward their intersection and inwardly turned free ends formed by the cut outs to define an opening f) a plastic insert positionable in the opening defined by the bracket, said insert having.

1. a body member adapted to fit in the opening,
2. a flange larger than the opening at one end of the body, and
3. a threaded throughbore through the flange and the body member, and g) a foot having a threaded stem extending therefrom and adapted to engage the threaded throughbore to provide an adjustable leg in which the distance from the foot to the bar can be adjusted by threading the stem through the threaded throughbore.

7. The device of claim 6 wherein the inwardly turned free ends are bent at substantially right angles toward each other to define with the uncut portions a substantially square opening.

8. The cross bar of claim 6 wherein the means for securing the leg in operating position include aligned openings in the cross bar vertical web and one flange of the main leg and means for interconnecting the openings.

9. The cross bar of claim 6 including more than one main leg extension.

10. The cross bar of claim 6 wherein the insert body member has external ribs adapted to engage the opening and hold the insert in the opening.

* * * * *